US005610580A

United States Patent [19]

Lai

[11] Patent Number: 5,610,580

[45] Date of Patent: Mar. 11, 1997

[54] MOTION DETECTION IMAGING DEVICE AND METHOD

[76] Inventor: Joseph M. Lai, 1922 West 33rd Avenue, Vancouver, British Columbia, Canada, V6M 1B4

[21] Appl. No.: 511,435

[22] Filed: Aug. 4, 1995

[51] Int. Cl.[6] ..... G08B 13/18

[52] U.S. Cl. ..... 340/541; 340/553; 340/554; 348/143; 348/155; 365/183; 396/427

[58] Field of Search ..... 340/553, 554, 340/541; 348/143, 155; 365/183; 354/3

[56] References Cited

U.S. PATENT DOCUMENTS

| | | | |
|---|---|---|---|
| 3,885,090 | 5/1975 | Rosenbaum | 360/5 |
| 4,942,464 | 7/1990 | Milatz | 340/541 |
| 5,155,474 | 10/1992 | Park et al. | 340/693 |
| 5,382,943 | 1/1995 | Tanaka | 340/693 |

FOREIGN PATENT DOCUMENTS

| | | |
|---|---|---|
| 0585033A1 | 3/1994 | European Pat. Off. . |
| 0595709A1 | 5/1994 | European Pat. Off. . |
| 6-165181 | 6/1994 | Japan . |

*Primary Examiner*—Glen Swann
*Attorney, Agent, or Firm*—Elbie R. de Kock

[57] ABSTRACT

A motion detection and imaging method and device 10 for carrying out the method are provided. The device 10 comprises a housing 12 containing a CCD 18 for providing digital image data, a lens 16 for focusing an image on the CCD 18 and a solid state non-volatile memory 24 for storing the digital image data. In one embodiment, the device includes a motion detector 26 for triggering the storage of the digital data.

12 Claims, 1 Drawing Sheet

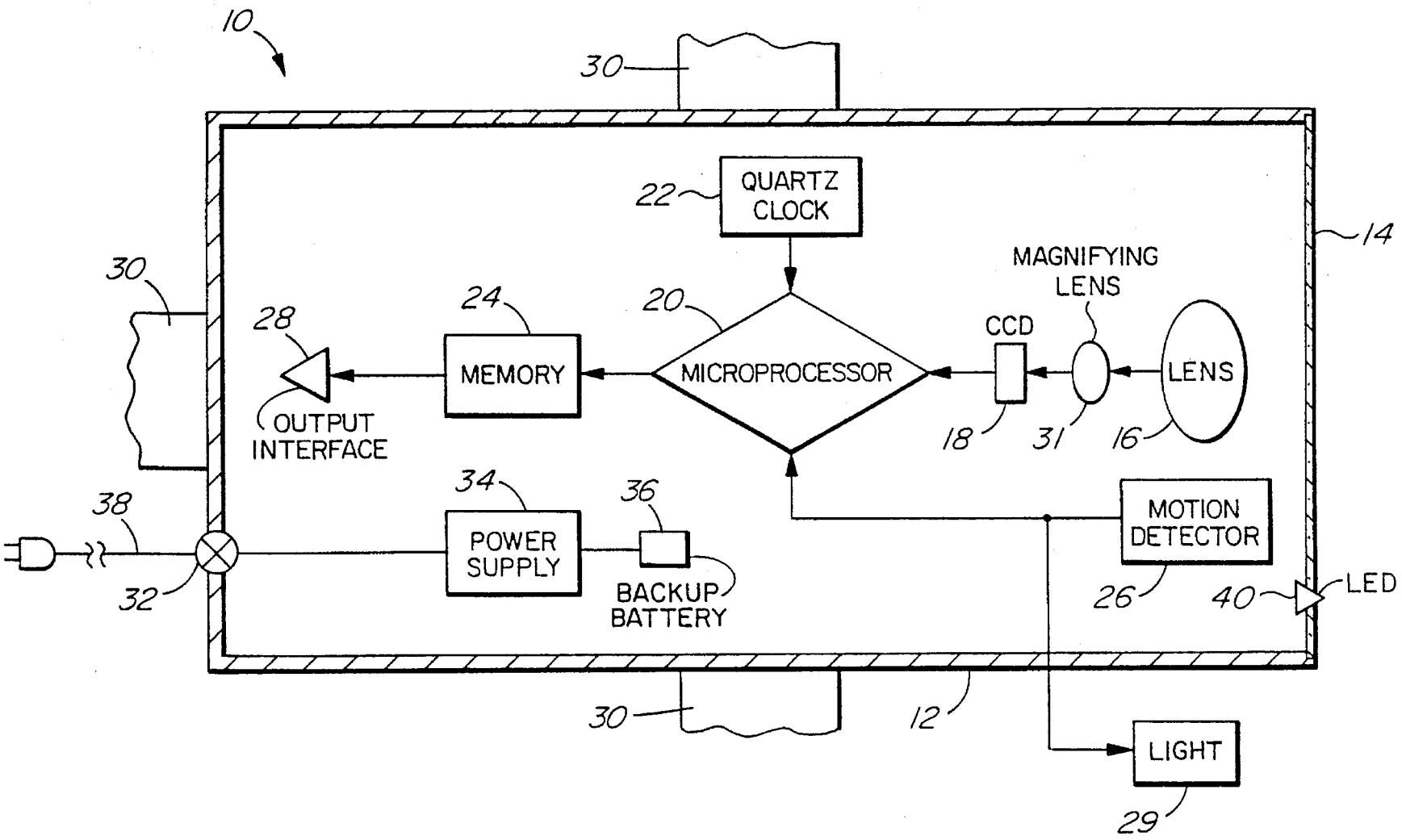
14
LED
40
LENS
16
MOTION DETECTOR
26
LIGHT
29
MAGNIFYING LENS
31
CCD
18
12
QUARTZ CLOCK
22
MICROPROCESSOR
20
30
BACKUP BATTERY
36
30
MEMORY
24
POWER SUPPLY
34
OUTPUT INTERFACE
28
10
30
38
32

MOTION DETECTION IMAGING DEVICE AND METHOD

FIELD OF THE INVENTION

This invention relates to a motion detection and imaging device and method, suitable for security purposes for the surveillance of a protected area.

BACKGROUND OF THE INVENTION

Various types of security systems for monitoring a protected area and making a recording of an image of a person entering the area, are known.

Normally these systems are expensive and comprise various inter-connected components in different locations and require on-site supervisory personnel. It is an object of the present invention to provide a self-contained unit which can easily be installed in an area to be monitored with no human intervention being required after installation until such time as the recorded images are required.

SUMMARY OF THE INVENTION

According to the invention there is provided a motion detection and imaging device comprising a housing containing a CCD for providing digital image data, a lens for focusing an image to be observed on the CCD and a solid state non-volatile memory for storing said digital image data.

The lens may comprise a wide angle lens assembly. The lens may include an electronic shutter.

The device may further comprise means for controlling opening of the shutter at predetermined time intervals for intermittently focussing an image on the CCD.

The device may further comprise a motion detector for triggering the storage of the digital data in the memory.

The device may also comprise means for compressing the digital data prior to storage in the memory and means for decompressing the data after retrieval from the memory.

The device may further comprise an electronic clock and calendar for timing and dating the digital data.

The device may also include a source of illumination.

Also according to the invention there is provided a motion detection and imaging method comprising the steps of focusing an image of an area being monitored on a CCD by means of a lens to provide digital image data and storing the data in a solid state non-volatile memory.

The image of the area being monitored may be focused on the CCD intermittently at predetermined time intervals to provide digital image data of a series of separate still pictures which is stored in the memory.

Further objects and advantages of the invention will become apparent from the description of a preferred embodiment of the invention below.

BRIEF DESCRIPTION OF THE DRAWINGS

The single drawing is a schematical representation of a motion detection and imaging device according to the invention.

DETAILED DESCRIPTION OF PREFERRED EMBODIMENT

In the drawing, reference numeral 10 generally indicates a motion detection and imaging device. The device 10 comprises a tamper resistant housing 12 provided with a transparent front 14. The housing 12 contains a wide angle lens assembly 16, a charge coupled imaging device (CCD) 18, a microprocessor 20, a quartz crystal controlled clock and calendar 22, a memory bank 24 comprising one or more solid state non-volatile high density memory chips, a microwave or ultrasound motion detector 26, an output interface 28 and a light 29. Due to the disparity between the size of a wide angle lens image and the diminitive size of a CCD, a magnifying lens 31 is placed in front of the CCD 18 so that the entire image from the lens assembly 16 will be recorded.

The device 10 further includes a key-operated on/off switch 32, an AC to DC converter, voltage regulator and battery charger 34 and a backup battery 36. A secured AC power supply connection 38 is provided for connecting the converter/regulator/battery charger 34 to an external power supply.

In the present example, the lens assembly 16 has a fixed focal length and incorporates an electronic shutter controlled by the microprocessor 20. The lens assembly 16 is mounted in front of the magnifying lens 31 for focussing an image of a protected area on the CCD 18. The CCD 18 produces a digitized image, the data of which is fed to the microprocessor 20. The digital image data is compressed by the microprocessor 20, using a suitable compression/decompression algorithm, e.g. according to the JPEG (joint Photographic Experts Group) standard. The compressed data is then stored in the memory bank 24. The size of the memory bank 24 is determined by the number of images which are required to be stored, the resolution and grayscale of the images, as well as the compression/decompression algorithm being employed.

The microprocessor 20 is programmed to store the compressed images sequentially on a first in first out basis so that the maximum number of the latest recorded images, dependent on memory size, is available for retrieval.

The microprocessor 20 is programmed to store the images at intervals, not continuously. Therefore, still images of the area being monitored will be stored at predetermined intervals, which intervals may be selected to be relatively short, i.e. to provide a quick sequence of images, or the intervals may be longer, as desired. In order to achieve this, the microprocessor 20 will control the electronic shutter to open at the predetermined intervals.

The storage of an image in the memory 24 is triggered by movement in the protected area, which is detected by the motion detector 26. The motion detector 26 also triggers the light 29, dependent on prevailing lighting conditions.

The electronic clock and calendar 22 operate to provide a time and date for the stored images.

The device 10 is operated by a voltage regulated DC power supply provided by the converter 34 from an external AC power source. The battery 36 serves as a back up should the AC power supply be interrupted.

The device 10 incorporates circuits with self-diagnostic functions and external LED indicators 40 are provided to indicate various failure modes, as desired.

In use, the housing 12 is installed in a location which is difficult to access but with a good view of the protected area to be monitored. Brackets 30 or other suitable means are provided on the housing 12 for mounting the housing 12 in position.

The motion detector 26 will detect movement in the protected area being monitored. This triggers the operation of the device 10 to receive, compress and store the images of the area in the memory 24. In the event of a security breach, the device 10 can be detached and connected to a PC or laptop with the appropriate software for viewing the latest series of recorded images.

The stored images are available for retrieval and decompression for analysis or enhancement, using interpolation techniques. If desired, a hard copy output can be provided.

The device 10 is provided as an integral standalone unit with all its components housed in the housing 12. It employs the low density imaging capability of a charge coupled device through a wide angle lens assembly with the high data storage density of a non-volatile memory chip(s).

Instead of using a lens assembly with a fixed focal length, provision may be made for auto-focussing of the lens assembly to provide for a better picture. Further refinements may also be provided, such as for example, automatic control of the lens aperture and shutter speed dependent on the lighting conditions.

While only preferred embodiments of the invention have been described herein in detail, the invention is not limited thereby and modifications can be made within the scope of the attached claims.

What is claimed is:

1. A motion detection and imaging device comprising a housing containing a CCD for providing digital image data, a wide-angle lens assembly for focusing an image to be observed on the CCD, a magnifying lens between the wide-angle lens assembly and the CCD and a solid state non-volatile memory for storing said digital image data.

2. The device according to claim 1, wherein the lens assembly includes an electronic shutter.

3. The device according to claim 2, further comprising means for controlling opening of the shutter at predetermined time intervals for intermittently focussing an image on the CCD.

4. A motion detection and imaging device comprising a housing containing a CCD for providing digital image data, a lens for focusing an image to be observed on the CCD, a solid state non-volatile memory for storing said digital image data and means for compressing the digital data prior to storage in the memory and means for decompressing the data after retrieval from the memory.

5. The device according to claim 4, further comprising an electronic clock and calendar for timing and dating the digital data.

6. A motion detection and imaging device comprising a housing containing a CCD for providing digital image data, a lens for focusing an image to be observed on the CCD, a solid state non-volatile memory for storing said digital image data and a motion detector for triggering the storage of the digital data in memory, wherein the housing is tamper resistant and has a transparent front and the lens and the motion detector are located adjacent the transparent front.

7. A motion detection and imaging method comprising the steps of focusing an image of an area being monitored on a CCD by means of a lens to provide digital image data, compressing the data by means of a suitable compression algorithm and storing the compressed data in a solid state non-volatile memory.

8. The method according to claim 7, wherein the image of the area being monitored is focussed on the CCD intermittently at predetermined time intervals to provide digital image data of a series of separate still pictures which is stored in said memory.

9. The method according to claim 7, further comprising the step of initiating the storage of the digital data by means of a motion detection device which detects movement in the area being monitored.

10. The method according to claim 7, wherein the lens comprises a wide angle lens assembly.

11. The method according to claim 7, further comprising the steps of measuring the light intensity in the area and illuminating the area if the light intensity is below a predetermined value.

12. A motion detection and imaging method comprising the steps of focusing an image of an area being monitored on a CCD by means of a wide-angle lens assembly to provide digital image data, including the step of placing a magnifying lens between the wide angle lens assembly and the CCD to capture the entire image from the wide angle lens assembly for the CCD and storing the data in a solid state non-volatile memory.

* * * * *